US005638605A

United States Patent [19]

Sligar

[11] Patent Number: 5,638,605

[45] Date of Patent: Jun. 17, 1997

[54] QUILTING-AID DEVICE AND METHOD

[76] Inventor: Sandra A. Sligar, 5285 N. Mesquite Dr., Prescott Valley, Ariz. 86314

[21] Appl. No.: 533,003

[22] Filed: Sep. 25, 1995

[51] Int. Cl.[6] ..... G01B 3/00

[52] U.S. Cl. ..... 33/494; 33/1 F; 112/475.08

[58] Field of Search ..... 33/1 F, 1 G, 483, 33/494, 679.1, 562, 563; 112/475.08, 117, 118, 119

[56] References Cited

U.S. PATENT DOCUMENTS 442,020 12/1890 Darling ..... 33/483

5,191,716 3/1993 Anderson ..... 33/483

5,557,996 9/1996 Reber et al. ..... 33/562 X

*Primary Examiner*—Paul C. Lewis

*Attorney, Agent, or Firm*—Martin L. Stoneman

[57] ABSTRACT

A quilting-aid device and method for use in making "two-color" squares for use in quilts, in which the quilter makes four of such squares from each larger square of two superimposed sheets of different material. The quilting-aid device, which saves the quilter from having to perform difficult calculations in the measuring and stitching and cutting of such squares, has two scales inscribed on a ruler-type base; a first scale on which to locate the desired size of two-color square and a second scale on which the corresponding position gives the size of the larger square with which to begin.

20 Claims, 3 Drawing Sheets

FIG. 2
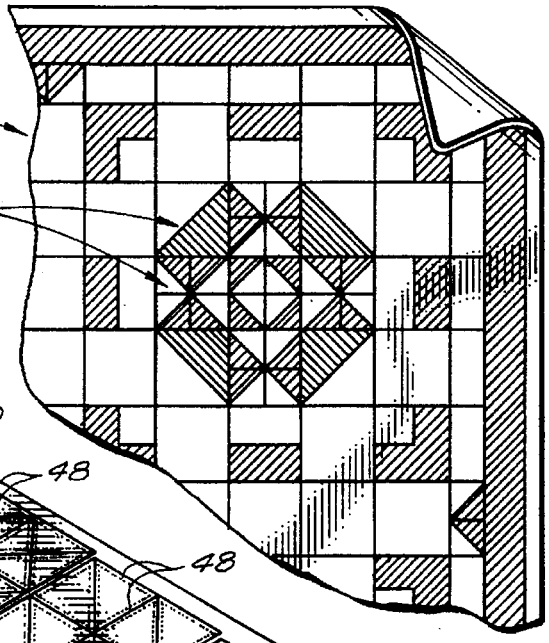
FIG. 1
PRIOR ART
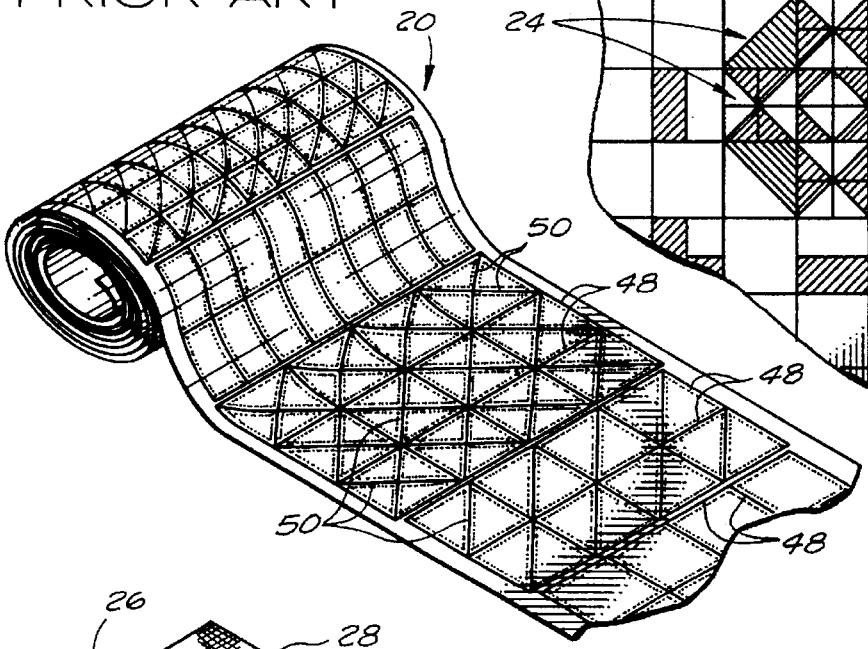
FIG. 3
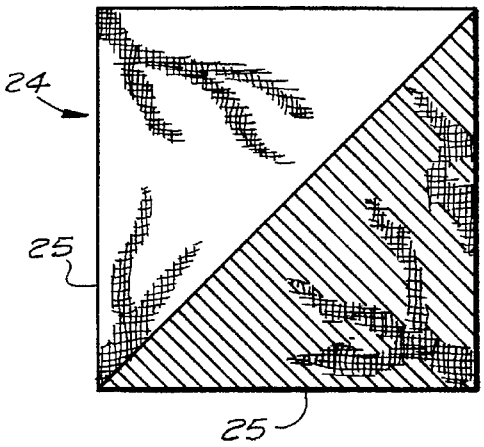
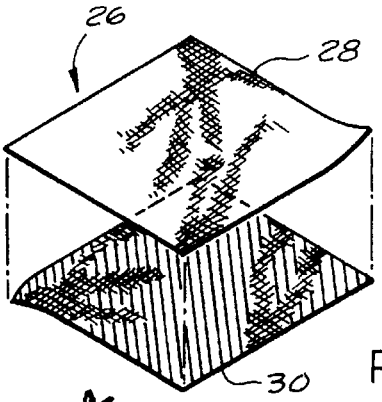
FIG. 4
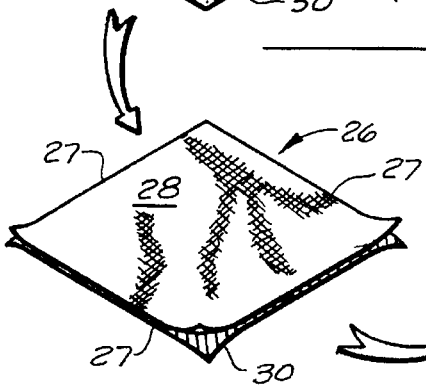
FIG. 5
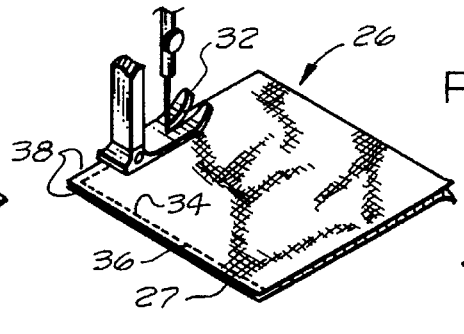
FIG. 6

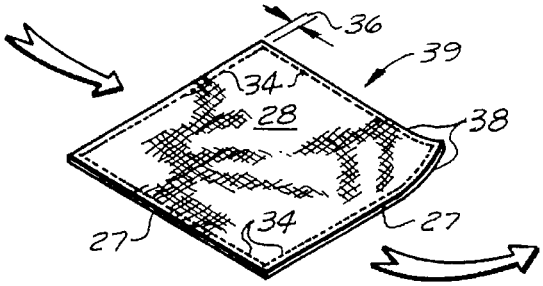
FIG. 7
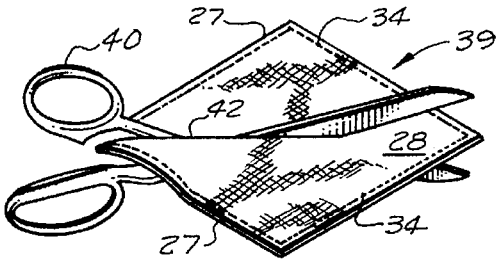
FIG. 8
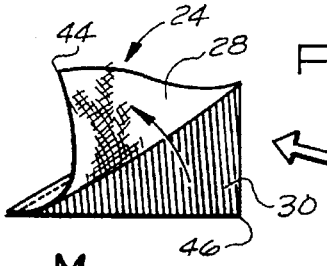
FIG. 10
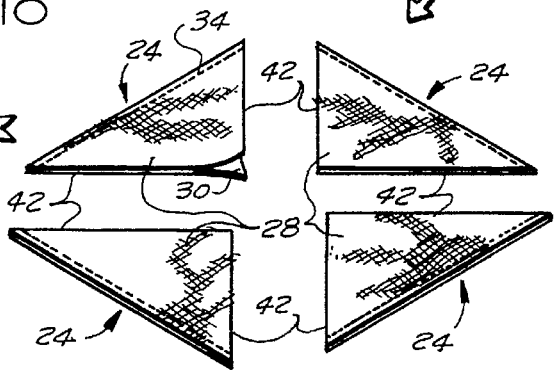
FIG. 9
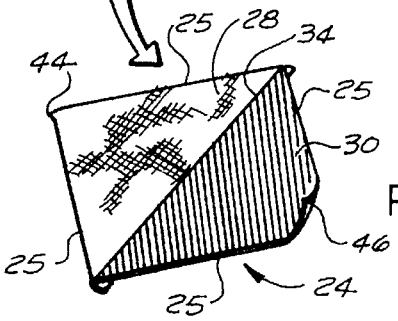
FIG. 11
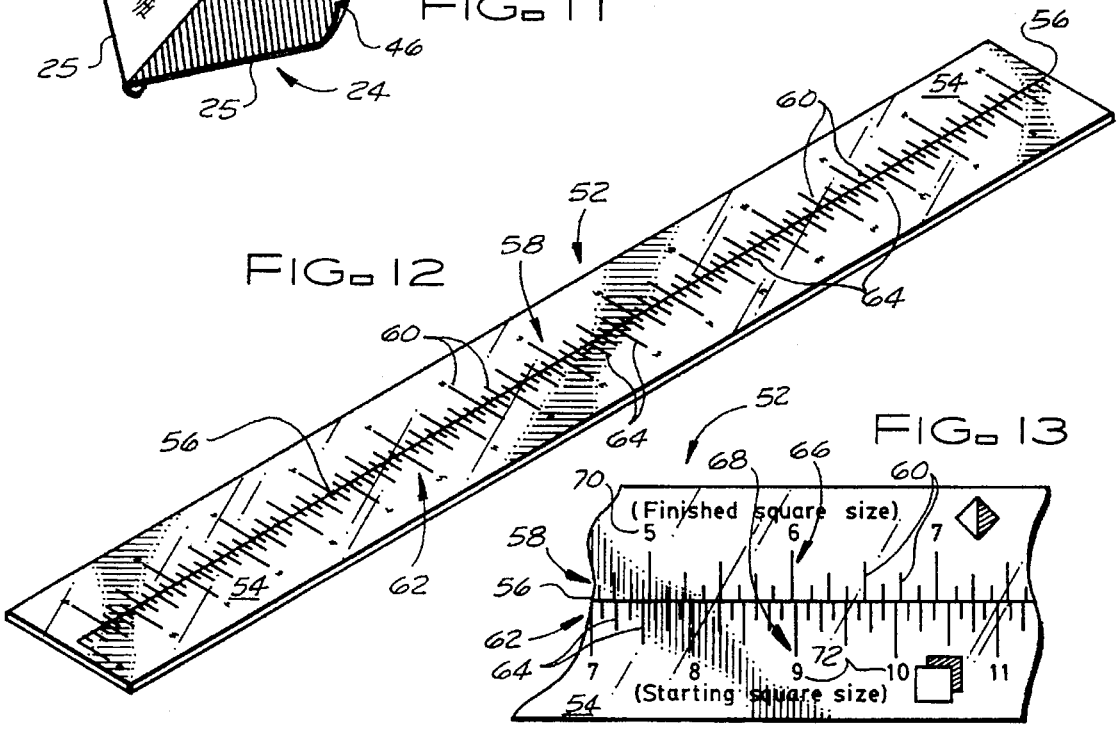
FIG. 12
FIG. 13

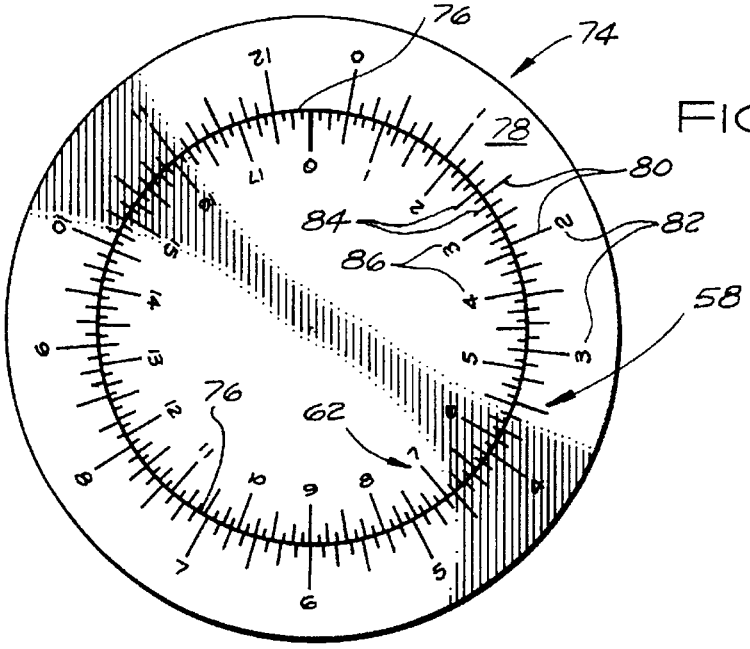
FIG. 14
FIG. 15
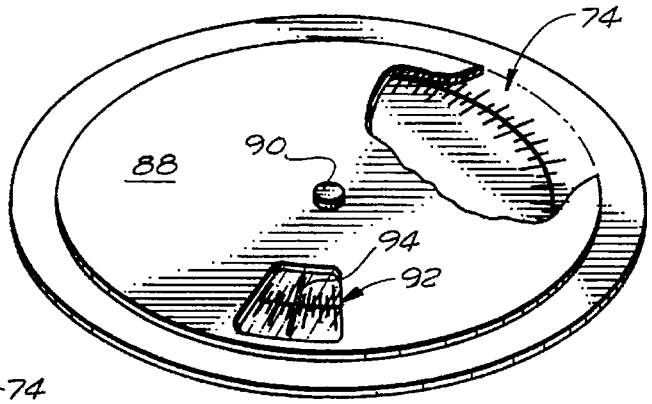
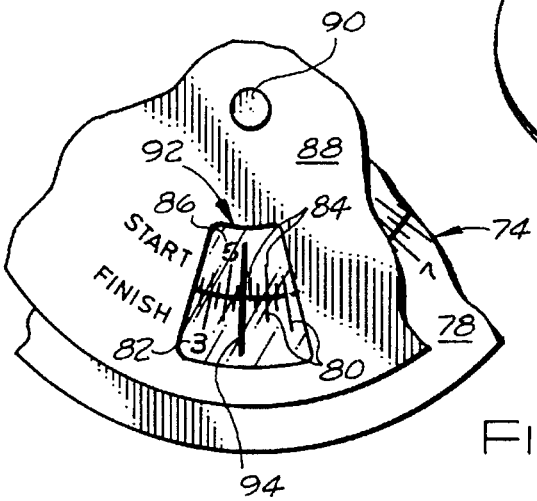
FIG. 16

QUILTING-AID DEVICE AND METHOD

BACKGROUND OF THE INVENTION

1. Field of the Invention

This invention relates to providing a quilting-aid device and method for use with a well-known way of making "two-color" squares for use in quilts. More particularly, this invention concerns quilting-aid devices and methods which provide a system whereby the quilt maker, in the making of such commonly used squares, is rescued from having to perform difficult calculations or reasoning in the measuring and stitching and cutting of such squares.

2. Description of the Prior Art

In the prior art, it is a common practice in quilting to want to use diagonally-stitched square-shaped pieces (called "squares") made up of two right-angled triangle-shaped pieces, (i.e., each having one corner/angle of about 90 degrees and two corners/angles of about 45 degrees each), each triangle piece being made of cloth having a different pattern and/or color than the other. These squares, often called two-color squares, are desired in a size selected by the quilt maker. There are several common methods of efficiently making such two-color squares, a very common one of which is: laying out for cutting "large" square-shapes large enough in area to provide four two-color squares in the desired size (even considering stitching losses); superimposing flatly a pair of these large squares, each such large square having a different pattern and/or color than the other; stitching these superimposed large squares together along a "square" line located a measured "proper-stitching" distance from the outer boundary of the superimposed large squares; cutting through such stitched-together superimposed large squares along both diagonals of the superimposed large squares; and pulling open the unstitched corners of the resulting four superimposed right-angled triangles to obtain four (smaller) diagonally-stitched two-color squares.

Since the quilt maker knows only the final desired dimensions of the desired small two-color squares but does not know the dimensions of the large squares needed to begin the above-described method of making the small two-color squares, the quilt maker is faced with doing whatever reasoning and calculating is necessary to select a large-square dimension that will work. Many quilters who desire to make quilts using such above-described method to make two-color squares of their own selected dimension feel lost and incompetent to figure out a proper starting large-square size. This is understandable since, to perform the required reasoning and calculating normally takes an understanding of using either mathematical square roots or mathematical sines as well as the geometrical effects of the loss of final usable area due to stitching.

Thus, faced with this prior-art problem, many quilters restrict themselves only to using two-color square sizes for which they have corresponding large-square patterns or for which they can purchase sheets of patterns to press onto their cloth materials to tell them where to sew and where to cut to end up with a pattern-product-specified two-color square size. And so many quilters lose the desirable size flexibility, spend extra money, etc.

OBJECTS OF THE INVENTION

A primary object of the present invention is to fulfill the above-mentioned need by the provision of quilting-aid devices and methods which overcome the prior-art complexities and permit a more efficient and more flexible size-selection and making of two-color squares. A further primary object of the present invention is to provide such quilting-aid devices which are easy to use and not confusing. In addition, it is a primary object of this invention to provide such quilting-aid devices and methods which save for the quilter much time, money, and aggravation. Other objects of this invention will become apparent with reference to the following invention descriptions.

SUMMARY OF THE INVENTION

According to a preferred embodiment of the present invention, there is provided a quilting-aid device for use with a quilting system using diagonally-stitched first squares measuring a number x per side, each such first square comprising a pair of right-angled triangles (each such triangle also having two 45 degree angles therein, as stated), wherein such squares are made by the following steps by the quilter: First, laying out for cutting second squares measuring a number y per side; Second, superimposing flatly a pair of such second squares; Third, stitching such superimposed second squares together along a "square" line located a measured number z from the outer boundary of such superimposed second squares; Fourth, cutting through such superimposed second squares along both diagonals of such superimposed second squares; and, Fifth, pulling open the unstitched corners of the resulting superimposed equilateral right triangles to obtain four of such diagonally-stitched first squares measuring x per side.

Such device, according to a preferred embodiment of the present invention, comprises, in combination: flat surface means constructed and arranged for the inscribing of indicia on such surface means; a line on such surface means; a first scale having a first set of inscribed ascending linear indicia, representing the number x, such first set being situate on a first side of such line; a second scale, having a second set of inscribed ascending linear indicia, representing the number y, such second set being situate on a second side of such line; and, for a selected value of such number x, corresponding to a first position along such first scale, reading means for reading, for a second position closest to such first position along such second scale, such number y corresponding to such second position.

Additionally, this invention provides such a quilting-aid device wherein such first scale and such second scale are constructed and arranged to provide a correct value of such number y for a selected such number x and a selected such number z. Yet further, this invention provides such a device wherein everywhere on such first scale and such second scale, for any such number x, such number y is equal to x divided by the sine of 45 degrees plus 2 times such number z [i.e., $y=(x/\sin 45)+2z$]. Additionally, this invention provides, according to this preferred embodiment, such device wherein such reading means comprises a first set of ascending numerical indicia associated with such first set of inscribed ascending linear indicia and a second set of numerical indicia associated with such second set of inscribed ascending linear indicia; and it provides such device wherein such first set of inscribed ascending linear indicia intersect such line and such second set of inscribed ascending linear indicia intersect such line; and it further provides such device wherein such first set of inscribed ascending linear indicia intersect such line at an angle of about 90 degrees and such second set of inscribed ascending linear indicia intersect such line at an angle of about 90 degrees.

Yet further, according to a preferred embodiment of the present invention, there is provided such a quilting-aid device wherein such numbers x, y, and z are denoted in inches and wherein such number z equals one-fourth of an inch. Even further, there is provided such a device wherein such first scale and such second scale are constructed and arranged to provide a correct value of such number y for a selected such number x; and further, wherein: such numbers x and y denote the such number in inches; and wherein everywhere on such first scale and such second scale, for any such number x, such number y is equal to x divided by the sine of 45 degrees, plus one-half inch; and, further, wherein such line is a straight line; and, further, wherein such flat surface means is shaped like a ruler.

Yet additionally, according to a preferred embodiment of the present invention, there is provided such a quilting-aid device wherein such line comprises a circular arc; and, further, wherein such flat surface means is shaped like a disk. Even additionally, this invention provides such a quilting-aid device including a rotatable flat cover member mounted adjoining such flat surface means, wherein such rotatable flat cover member and such flat surface means are rotatably mounted together at the center of such flat surface means; and, further, wherein such reading means comprises a transparent window in such rotatable flat cover member; and, further, wherein such transparent window includes a pointing member constructed and arranged to assist in reading such number y for a selected such number x.

Yet further, according to a preferred embodiment of the present invention, there is provided, in a quilting system using diagonally-stitched first squares measuring a number x per side, each such square comprising a pair of right-angled triangles wherein the method of making such first squares comprises the steps of: laying out for cutting second squares measuring a number y per side; superimposing flatly a pair of such second squares; stitching such superimposed second squares together along a "square" line located a measured number z from the outer boundary of such superimposed second squares; cutting through such superimposed second squares along both diagonals of such superimposed second squares; and pulling open the unstitched corners of the resulting superimposed right-angled triangles to obtain four of such diagonally-stitched first squares measuring x per side; THE IMPROVEMENT comprising the steps of: locating a first position representing such number x on a first scale having a first set of inscribed ascending linear indicia and associated numerical indicia along a first side of a line; locating a second position along a second side of such line, and closest to such first position, on a second scale having a second set of inscribed ascending linear indicia and associated numerical indicia along such second side of such line; and reading from such second scale a number corresponding to such second position as such number y.

Additionally, this invention provides such a method wherein such number z is ¼ inch. And there is further provided such a method wherein such numbers x and y denote the such number in inches; and wherein everywhere on such first scale and such second scale, for any such number x, such number y is equal to x divided by the sine of 45 degrees, plus one-half inch. Also, this invention provides such a method wherein such reading is assisted by a pointer connecting such first position and such second position.

BRIEF DESCRIPTION OF THE DRAWINGS

FIG. 1 illustrates pictorially a pattern sheet for use in a prior art method of making two-color squares from two superimposed sheets without quilter calculation.

FIG. 2 illustrates pictorially a section of a quilt made with two-color squares.

FIG. 3 is a plan view of a two-color square of the type used in quilting.

FIGS. 4 through 11 illustrate pictorially a widely-used method of making four two-color squares from each larger square of two superimposed sheets of different material.

FIG. 12 illustrates pictorially, in perspective, a quilting-aid device according to a preferred embodiment of the present invention.

FIG. 13 is a partial expanded view of the top of the quilting-aid device of FIG. 12.

FIG. 14 is a plan view of a quilting-aid device according to another preferred embodiment of the present invention.

FIG. 15 is a perspective view, partially in section, of a modification of the quilting-aid device of FIG. 14.

FIG. 16 is a partial expanded view of the top of the quilting-aid device of FIG. 15.

DETAILED DESCRIPTION OF A PREFERRED EMBODIMENT AND THE BEST MODE OF PRACTICE

FIG. 1 illustrates pictorially a pattern sheet 20 for use in a prior art method, which shall be referred to hereinafter, of making two-color squares from two superimposed sheets without quilter calculation.

FIG. 2 illustrates pictorially a section of a quilt 22 made with two-color squares 24 (each having four sides 25), some of which are identified in FIG. 2 for explanation purposes. FIG. 3 is a plan view of a single two-color square 24 of the type used in quilting, as exemplified in FIG. 2.

FIGS. 4 through 11 illustrate pictorially a widely-used method of making four two-color squares 24 from each larger square 26 (each having four sides 27) of two superimposed sheets of different material, upper larger-square-size sheet 28 and lower larger-square-size sheet 30 (see FIG. 4). Normally, sheets 28 and 30 are superimposed and either laid out for cutting or cut to obtain a larger square 26. FIGS. 4 and 5 show a larger square 26, large enough in area to provide four two-color squares 24 in the desired size (even considering stitching losses, as later hereinafter discussed) made by superimposing flatly a pair of larger-square-size sheets 28 and 30, each such larger-square-size sheet 28 having a different pattern and/or color than the other such sheet 30. Then, as shown in FIG. 6, These superimposed sheets 28 and 30 are stitched together (as by a sewing device 32 as partially illustrated in FIG. 6) along a "square" line 34 located a measured "proper-stitching" distance 36 from the outer boundary 38 (the four sides 27) of the larger square 26, resulting, as shown in FIG. 7, in larger square 26 being sewn all along its boundary 38.

Then, as shown in FIGS. 8 and 9, the stitched larger square 39 (made from larger square 26) of FIG. 7 is cut (as by scissors 40 as illustrated in FIG. 8) through stitched-together superimposed upper sheet 28 and lower sheet 30 along both diagonals 42 of stitched larger square 39, resulting in the four two-color squares 24, shown in FIG. 9 immediately after such cutting. Then, as shown for a single two-color square 24 in FIGS. 10 and 11, each two-color square 24 is readied for quilting by pulling open the unstitched corners 44 and 46, respectively of upper sheet 28 and lower sheet 30, of each of the two-color squares 24 (shown cut into superimposed-sheet right-angled triangles in FIG. 9) to obtain four diagonally-stitched two-color squares 24, each having four sides 25. Then, in whatever pattern may be desired, each two-color square 24, as illustrated in FIG. 11 and FIG. 3, may be stitched into a quilt location in well-known manners, as exemplified in quilt 22 of FIG. 2.

Thus, it is now easily seen that, since the quilt maker, the quilter, knows only the final desired dimensions, usually referred to as the size of a side 25, of the desired (smaller) two-color squares 24 but does not know the dimensions (usually referred to as the size of a side 27) of the larger squares 26 needed to begin the above-described method of making two-color squares 24, the quilt maker is faced with doing whatever reasoning and calculating is necessary to select a larger-square dimension or side-size (of side 27) that will work. Many quilters who desire to make quilts using such above-described method to make two-color squares 24 of their own selected dimension or side-size (of side 25) feel lost and incompetent to figure out a proper starting larger-square side size for side 27.

This is understandable since, to perform the required reasoning and calculating normally takes an understanding of using either mathematical square roots or mathematical sines as well as the geometrical effects of the loss of final usable area due to stitching. For example, from the geometry of the situation of the described method of FIGS. 4–11, for any desired two-color square side 25 size x, the larger square side 27 size y will be equal to x divided by the sine of 45 degrees, plus 2 times the distance 36 from a boundary 38 to the stitching (since some cloth will be "lost" because of the need to stitch at least some minimum distance from a boundary 38, as is well known). Thus, to follow this example, if a quilter wishes two-color squares of approximately three inches per side 25, and if the quilter desires to stitch one-fourth inch from boundary 38 (which distance is usually advisable), then the quilter must obtain a value for the sine of 45 degrees, divide three inches by the value of the sine of 45 degrees, and add to the result twice the "lost" sewing "boundary" (in this example, two times one-quarter inch, or one-half inch). Furthermore, if a calculator is used, the quilter must convert the decimal to a usable fraction for rotary cutting. And then—if there is no confusion or errors—the quilter will know to make the side 27 of the larger square 26 equal approximately to four and three-fourths inches. Most quilters avoid such confusion.

Thus, faced with this prior-art problem, many quilters restrict themselves only to using two-color square side 25 sizes for which they have corresponding larger-square 26 patterns or for which they can purchase sheets of patterns to press onto their cloth materials to tell them where to sew and where to cut to end up with a pattern-product-specified two-color square size, as illustrated by the pattern of pattern sheet 20 of FIG. 1, permitting quilters who will settle for the two-color side 25 size dictated by the pattern sheet 20 to stitch both sides adjoining, e.g., all the "square" boundary lines 48, and then to cut along all the diagonals 50. And so, it is reiterated that many quilters lose the desirable size flexibility, spend extra money, etc.

FIG. 12 illustrates pictorially, in perspective, a quilting-aid device 52 according to a preferred embodiment of the present invention; and FIG. 13 is a partial expanded view of the top of the quilting-aid device 52 of FIG. 12. The upper surface 54 of the ruler-shaped quilting-aid device 52 provides a flat surface means constructed and arranged for the inscribing of indicia thereon. A line 56 (a longitudinal straight line in this embodiment) is inscribed on surface 54. On one side of line 56 there is inscribed on surface 54 a first scale 58 having a first set of inscribed ascending linear indicia 60, representing the desired size of side 25 of a desired two-color square 24 (the number x in the example given above). On the other side of line 56 there is inscribed on surface 54 a second scale 62 having a second set of inscribed ascending linear indicia 64, representing the size to be chosen for side 27 of a larger square 26 (the number y in the example given above).

For a selected value of the number x, corresponding to a first position (e.g., in FIG. 13, for the number 6) 66 along first scale 58, it will be seen that, for a second position (e.g., for approximately the number 9) 68 closest to first position 66 along second scale 62, such second position corresponds to the number y in the example given above in the case where the distance 36, i.e., the distance z in the above example, is equal to one-fourth inch, a usual desire. Note that the zero position on first scale 58 corresponds to the one-half inch position on second scale 62. Note that in quilting-aid device 52, first scale 58 and second scale 62 are constructed and arranged to provide a correct value of such number y for a selected such number x and a selected such number z (selected in the illustrated embodiment to equal one-fourth inch).

Note that the reading means for reading the number y to be used by the quilter comprises a first set of ascending numerical indicia 70 associated with the first set of inscribed ascending linear indicia 60 and a second set of ascending numerical indicia 72 associated with second set of inscribed ascending linear indicia 64. Note further, for reading efficiency, the first set of inscribed ascending linear indicia 60 intersect line 56 and the second set of inscribed ascending linear indicia 64 intersect line 56 also; and further that the first set of inscribed ascending linear indicia 60 intersect line 56 at an angle of about 90 degrees and the second set of inscribed ascending linear indicia 64 intersect line 56 at an angle of about 90 degrees.

FIG. 14 is a plan view of a quilting-aid device according to another preferred embodiment of the present invention; and FIG. 15 is a perspective view, partially in section, of a modification of the quilting-aid device of FIG. 14; and FIG. 16 is a partial expanded view of the top of the quilting-aid device of FIG. 15.

With respect to the embodiment of FIG. 14, the illustrated quilting-aid device 74 is a disk-shaped device which corresponds to the ruler-shaped quilting-aid device 52. Line 76, in the shape of a circular arc, corresponds functionally to straight line 56. The upper surface 78 of quilting-aid device 74 here comprises a flat surface means. On the outer side of line 76, inscribed on surface 78, are indicia 80 and numerical indicia 82 functionally corresponding respectively to indicia 60 and numerical indicia 70 of quilting-aid device 52; and on the inner side of line 76, inscribed on surface 78, are indicia 84 and numerical indicia 86 functionally corresponding respectively to indicia 64 and numerical indicia 72 of quilting-aid device 52.

With respect to FIGS. 15 and 16, quilting-aid device 74 may include a rotatable flat cover member 88 mounted adjoining upper surface 78 by means of rotatable pin connection 90 at the centers of cover member 88 and upper surface 78 in well-known ways. And the alternate reading means of the present invention may include a transparent window 92 in rotatable flat cover member 88; the transparent window 92 including a pointing member 94 constructed and arranged, as shown, to assist in reading the number y for a selected number x. In other words, with reference to FIG. 16, pointing member 94 is positioned over the scale on the outer side of line 76 over the side 25 size (also called x herein) at the "FINISH" of making the two-color square 24; and then the number y of the side 27 size of the larger square 26 to "START" with, in the described method of making two-color squares 24, may be read from the position of pointing member 94 over the scale on the inner side of line 76.

Thus, in using the preferred embodiment of the quilting-aid device 52 or 74 of the present invention in connection with the described system of making two-color squares 24, a quilter performs the steps of: locating a first position representing the described number x on a first scale 58 having a first set of inscribed ascending linear indicia 60 or 80 and associated numerical indicia 70 or 82 along a first side of a line 56 or 76; locating a second position along a second side of such line 56 or 76, and closest to such first position, on a second scale 62 having a second set of inscribed ascending linear indicia 64 or 84 and associated numerical indicia 72 or 86 along such second side of such line 56; and reading from such second scale 62 a number corresponding to such second position as such described number y, giving the user the side 27 size for the larger square 26 with which to begin the described system for making two-color squares 24.

In making the device of the present invention, rigid plastic materials are preferred to be used, and in well-known ways. Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A quilting-aid device for use with a quilting system using diagonally-stitched first squares measuring a number x per side, each said first square comprising a pair of right-angled triangles, wherein said first squares are made by: laying out for cutting second squares measuring a number y per side; superimposing flatly a pair of said second squares; stitching said superimposed second squares together along a "square" line located a measured number z from the outer boundary of said superimposed second squares; cutting through said superimposed second squares along both diagonals of said superimposed second squares; and pulling open the unstitched corners of the resulting superimposed right-angled triangles to obtain four of said diagonally-stitched first squares measuring x per side; said device comprising, in combination:

a. flat surface means constructed and arranged for the inscribing of indicia on said surface means;

b. a line on said surface means;

c. a first scale having a first set of inscribed ascending linear indicia, representing the number x, said first set being situate on a first side of said line;

d. a second scale, having a second set of inscribed ascending linear indicia, representing the number y, said second set being situate on a second side of said line; and e. for a selected value of said number x, corresponding to a first position along said first scale, reading means for reading, for a second position closest to said first position along said second scale, said number y corresponding to said second position.

2. A quilting-aid device according to claim 1 wherein said first scale and said second scale are constructed and arranged to provide a correct value of said number y for a selected said number x and a selected said number z.

3. A quilting-aid device according to claim 1 wherein everywhere on said first scale and said second scale, for any said number x, said number y is equal to x divided by the sine of 45 degrees, plus 2 times said number z.

4. A quilting-aid device according to claim 1 wherein said reading means comprises a first set of ascending numerical indicia associated with said first set of inscribed ascending linear indicia and a second set of numerical indicia associated with said second set of inscribed ascending linear indicia.

5. A quilting-aid device according to claim 4 wherein said first set of inscribed ascending linear indicia intersect said line and said second set of inscribed ascending linear indicia intersect said line.

6. A quilting-aid device according to claim 5 wherein said first set of inscribed ascending linear indicia intersect said line at an angle of about 90 degrees and said second set of inscribed ascending linear indicia intersect said line at an angle of about 90 degrees.

7. A quilting-aid device according to claim 1 wherein said numbers x, y, and z are denoted in inches and wherein said number z equals one-fourth of an inch.

8. A quilting-aid device according to claim 7 wherein said first scale and said second scale are constructed and arranged to provide a correct value of said number y for a selected said number x.

9. A quilting-aid device according to claim 8 wherein: said numbers x and y denote the said number in inches; and wherein everywhere on said first scale and said second scale, for any said number x, said number y is equal to x divided by the sine of 45 degrees, plus one-half inch.

10. A quilting-aid device according to claim 9 wherein said line is a straight line.

11. A quilting-aid device according to claim 10 wherein said flat surface means is shaped like a ruler.

12. A quilting-aid device according to claim 9 wherein said line comprises a circular arc.

13. A quilting-aid device according to claim 12 wherein said flat surface means is shaped like a disk.

14. A quilting-aid device according to claim 13 including a rotatable flat cover member mounted adjoining said flat surface means, wherein said rotatable flat cover member and said flat surface means are rotatably mounted together at the center of said flat surface means.

15. A quilting-aid device according to claim 14 wherein said reading means comprises a transparent window in said rotatable flat cover member.

16. A quilting-aid device according to claim 15 wherein said transparent window includes a pointing member constructed and arranged to assist in reading said number y for a selected said number x.

17. In a quilting system using diagonally-stitched first squares measuring a number x per side, each said square comprising a pair of right-angled triangles wherein the method of making said first squares comprises the steps of:

a. laying out for cutting second squares measuring a number y per side;

b. superimposing flatly a pair of said second squares;

c. stitching said superimposed second squares together along a "square" line located a measured number z from the outer boundary of said superimposed second squares;

d. cutting through said superimposed second squares along both diagonals of said superimposed second squares; and e. pulling open the unstitched corners of the resulting superimposed right-angled triangles to obtain four of said diagonally-stitched first squares measuring x per side;

the improvement comprising the steps of:

f. locating a first position representing said number x on a first scale having a first set of inscribed ascending linear indicia and associated numerical indicia along a first side of a line;

g. locating a second position along a second side of said line, and closest to said first position, on a second scale having a second set of inscribed ascending linear indicia and associated numerical indicia along said second side of said line; and h. reading from said second scale a number corresponding to said second position as said number y.

18. A method according to claim 17 wherein said number z is ¼ inch.

19. A method according to claim 18 wherein said numbers x and y denote the said number in inches; and wherein everywhere on said first scale and said second scale, for any said number x, said number y is equal to x divided by the sine of 45 degrees, plus one-half inch.

20. A method according to claim 19 wherein said reading is assisted by a pointer connecting said first position and said second position.

* * * * *